US006666174B1

(12) United States Patent
Lesage

(10) Patent No.: US 6,666,174 B1
(45) Date of Patent: Dec. 23, 2003

(54) ELEVATING BASE FOR GAS-FIRED WATER HEATER

(75) Inventor: Claude Lesage, Pointe Claire (CA)

(73) Assignee: Giant Factories Inc., Montreal (CA)

( * ) Notice: Subject to any disclaimer, the term of this patent is extended or adjusted under 35 U.S.C. 154(b) by 0 days.

(21) Appl. No.: 10/254,585

(22) Filed: Sep. 26, 2002

(51) Int. Cl.[7] ..... F22B 5/04
(52) U.S. Cl. ..... 122/19.2; 122/14.21
(58) Field of Search ..... 122/13.01, 14.2, 122/14.21, 14.31, 17.1, 19.2; 248/346.01

(56) References Cited

U.S. PATENT DOCUMENTS 1,156,814 A * 10/1915 Reed ..... 122/17.2
4,477,399 A * 10/1984 Tilton ..... 264/45.2
5,091,715 A * 2/1992 Murphy ..... 340/604
5,235,161 A * 8/1993 Reusche et al. ..... 219/523
5,836,554 A * 11/1998 Lesage ..... 248/152
6,497,200 B2 * 12/2002 Stretch et al. ..... 122/504

* cited by examiner

*Primary Examiner*—Gregory Wilson
(74) *Attorney, Agent, or Firm*—Ogilvy Renault; Guy J. Houle

(57) ABSTRACT

A base for rendering a gas-fired water heater, having a lower combustion chamber, explosion-proof, is described. The base has elevating supports which are provided with securement means in an upper portion thereof for securing same to a bottom end of a gas water heater housing whereby to support the gas water heater elevated from a floor surface. One or more vapour detectors are associated with the base to detect the presence of combustible vapours. The vapour detectors are connected to a switch to shut off a gas burner and pilot in the combustion chamber before the combustible vapours reach the flame of the gas burner and/or pilot through combustion chamber air supply passages in a lower end of the gas water heater housing. The temperature in the chamber is lower than the temperature of ignition of gas vapour.

75 Claims, 3 Drawing Sheets

ELEVATING BASE FOR GAS-FIRED WATER HEATER

FIELD OF THE INVENTION

The present invention relates to a base for rendering a gas-fired water heater explosion-proof by elevating the water heater and its combustion chamber from a floor surface and by using vapour detector(s) to detect the presence of combustible vapours before they can reach the combustion chamber.

BACKGROUND OF THE INVENTION

Gas water heaters are provided with a combustion chamber in the lower part thereof where a gas burner is located to heat the bottom tank wall of the water heater to produce hot water. The combustion chamber has openings whereby to admit fresh air for mixture with the gas to produce a combustible product. These gas water heaters can be hazardous if they are utilized in areas where there is a risk that combustible vapours may propagate in the area of the air supply to the burners. Usually, combustible vapours will accumulate on a floor surface, because they are heavier than air, and slowly build up and rise thus creating a large cloud of ignitable gas vapours. If such a cloud of vapour propagates to the combustion chamber of a gas water heater it will ignite and cause a very serious explosion and usually destroy the gas water heater and fragment the gas line to add further fuel to the fire. Needless to say, such explosion would be disastrous to any person in the immediate vicinity of the gas water heater and cause a building fire.

Gas water heaters can be installed in garages. However, in garages fumes are usually released by automobiles due to gas leakage or the storage of paint or the use of glues and other such combustible vapour generating products that we usually find in work areas of a garage. The basement of a residence is also another hazardous location where dangerous products are stored. In the past, various attempts have been made to deal with this problem but to date none has proven satisfactory.

It is known to provide sealed combustion chambers and provide duct work whereby to admit fresh air from the outside into these chambers for the combustible products. We usually find such installations in gas fireplaces and these fire places are usually installed close to an outside wall for this purpose. The chimney duct work of these gas appliances are usually formed by concentric piping wherein the centre pipe is used as a flue and the annular channel thereabout formed by the spaced outer pipe acts as the fresh air intake to the combustion chamber. This process in water heater is known as "direct vent water heater" and has been widely used for more than six years. Wall distance from the appliance is the limitation of the application.

There is currently millions of gas water heaters in operation and most of these are fed combustible air through the base of the housing of the water heater and they are subjected to the above-mentioned problems.

SUMMARY OF THE INVENTION

It is a feature of the present invention to provide a base for rendering a gas water heater substantially explosion-proof.

Another feature of the present invention is to provide a base which is adaptable to existing water heaters whereby to provide a retrofit to elevate the water heaters from a floor support surface and wherein vapour detectors are associated with the base to render the water heater substantially explosion-proof by early switching off the gas supply and extinguishing the burner, the pilot flames and cooling the components in the combustion chamber.

Another feature of the present invention is to provide a base and a connector whereby to secure the base to existing gas water heaters to support the water heaters elevated from a floor support surface and wherein detecting and switching means is provided to shut off the gas supply to the burner of the combustion chamber and pilot and burner flames upon detection of combustible vapours.

According to the above features, from a broad aspect, the present invention provides a base for rendering a gas-fired water heater, having a lower combustion chamber, explosion-proof. The base has elevating support means to support the water heater elevated from a floor surface. One or more vapour detectors are associated with the base to detect the presence of combustible vapours. The vapour detectors are connected to switching means to shut-off a gas burner and pilot in the combustion chamber before the combustible vapour reach the gas burner and pilot through combustion chamber air supply passages in a lower end of the gas water heater housing.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 1:
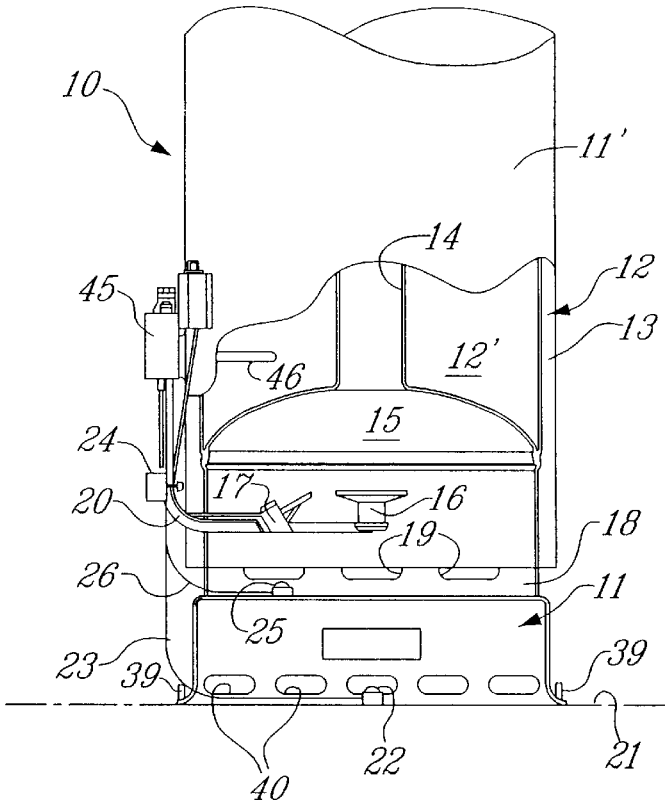
FIG. 1 is a partly fragmented side view showing the construction of a gas water heater to which the base of the present invention has been secured to support the water heater elevated from a floor surface.

Referring now to the drawings and more particularly to FIG. 1 there is shown generally at 10 a gas water heater secured to the elevating base 11 of the present invention. The gas water heater 10 generally consists of a housing 11' which is spaced from an inner steel tank 12 containing water to be heated. Insulation is injected or disposed in the space 13 to insulate the tank 12. The tank has a center flue 14 for the escape of combustible gas. The flue communicates with a combustion chamber 15 in which there is disposed a gas burner 16 and a pilot igniter 17. The lower portion 18 of the tank 10 is provided with vent holes 19 or open spaces to admit fresh air in the combustion chamber 15 for admixture with gas supplied thereto by the main gas line 20 to provide an ignitable mixture to produce a flame to heat the water within the tank.

A second vapour detector 25 is also provided with wiring 26' which connects to the switch 24 to provide secondary detection in the event of failure of the first detector. This is an optional switching feature to provide added security.

Figure 2:
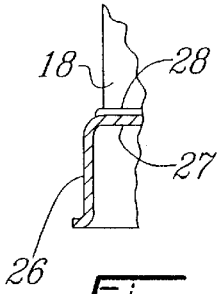
FIG. 2 is a fragmented, partly sectioned, view showing the base welded to the housing of the water heater.
Figure 3:
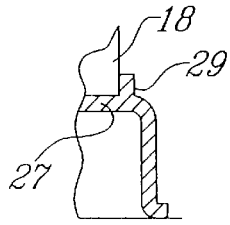
FIG. 3 is a view similar to FIG. 2 showing the base press-fitted to the lower portion of the housing of the water heater.

With reference now to FIGS. 2 and 3 there is shown different forms of securement means whereby to secure an upper portion of the base to a bottom end of a gas water heater housing. As shown in FIG. 2 the elevated base is formed by a cylindrical contour wall 26 formed of metal sheeting. The contour wall 26 is provided with a top wall or a flange portion 27 whereby to receive the lower end portion 18 of the gas water heater thereon. The securement means is herein shown by a contour weld or spot welds 28 disposed about the lower portion 18 in the top wall 27.

As shown in FIG. 3 the top wall 27 is provided with a plurality of flanges 29 which are punched out of the top wall whereby to receive the lower portion 18 of a gas water heater in close fit therein for retention. Of course, there are various other means to secure the base to the lower end of a gas water heater.

Figure 4:
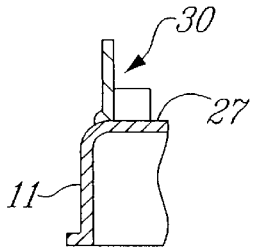
FIG. 4 is a further view similar to FIGS. 2 and 3 but showing an adaptor ring or bracket secured to a top wall of the support base to retrofit the base to water heaters of different diameters.
Figure 5:
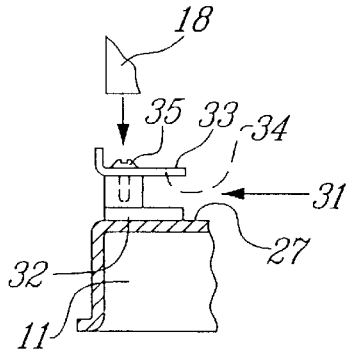
FIG. 5 is a view similar to FIG. 4 but showing a different type of securement means in the form of an adjustable bracket secured to the top wall of the base to retrofit same to water heater housings of different diameters.

FIGS. 4 and 5 illustrate a few other examples of such securement means. For example, as shown in FIG. 4, the base 11 is provided with an adaptor ring hereinshown in cross-section and which has a predetermined diameter whereby to adapt the base 11 to water heaters having different diameter lower portions. The adaptor ring 30 may be secured to the top wall 27 of the base by various means such as welding or the use of fasteners such as rivets, etc.

FIG. 5 shows an adjustment bracket 31 for securing the base to the lower portion of gas water heaters of different diameter sizes. As hereinshown the adjustment bracket is secured to the top wall 27 by a connector flange 32. The connector flange has an adjustable bracket 33 whereby to receive, in close fit therein, the lower portion 18 of the gas water heater. The adjustment bracket 33 is provided with a slot 34 for adjustability thereof and secured in place by a fastener 35. Again, these are only examples of the various securement means to secure the base to existing gas water heaters. These securement means provide for a universal mount whereby to retrofit the base to present installation to add safety to an existing system without the proprietor having to invest in a new heater. It is pointed out that since all gas water heaters have an expected life of about 10 years, this support base allows the consumer to purchase a single universal base and exchange defective water heaters with conventional water heaters which are then mounted on the universal base. Accordingly, it is preferred that the base have a disconnectable means, although not essential. The sensors also utilize electronic circuitry and do not have any moving parts so that the life of these is expected to be in the range of 30 to 40 years and this adds safety to the system. An important feature of the base is that it does not require that the combustion chamber be sealed and provided with expensive feed pipes. The base is reusable when the heater leaks thus providing material saving and lower costs to the consumer. Accordingly, the base provides for an existing need which is economical and easy to adapt to existing water heaters while providing the security and reliability to prevent explosions from occurring with such gas-fired water heaters.

The contour wall 26 of the base is also provided with apertures 40 to permit the circulation of air under the base in the event of water leakage which could provide rusting thereof. These vent holes make it such that the air can move freely under the base.

As shown if FIG. 1 the elevated base 11 may also be provided with adjustment legs 39 thereabout for assuring that the gas water heater base is levelled with the floor support surface 21.

The vapour detection system as described herein will now be described in more detail with reference to FIGS. 6–8. The system works on a single 12 volt battery or 8 AA batteries that will last from approximately 8 to 36 hours and need to be connected to a 110 volts supply for charging the batteries or thermopile. The vapour sensors may be Model TGS813 supplied by a company by the name of Figaro. These detectors are capable of sensing gas vapour such as gasoline, propane, lacquer thinners, glue solvents, and many more such gas vapours.

Figure 6:
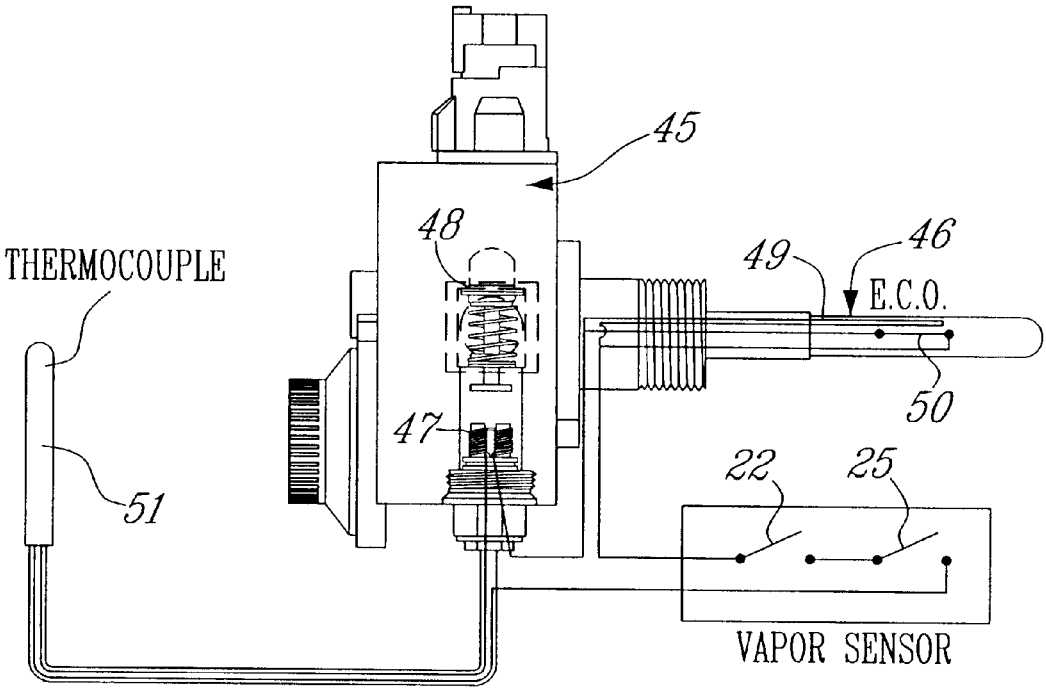
FIG. 6 is a schematic side view of a gas valve showing the connection of the vapour sensors to the relay coil of a gas valve.

Referring now to FIG. 6 there is shown a schematic illustration of the construction of the gas valve 45. This gas valve is associated with a heat detector probe 46 which includes an (E.C.O.) and it extends into the water reservoir (See FIG. 1), of the inner tank 12 of the water heater. The probe 46 actuates the relay coil 47 of the gas shutoff valve 48 when the temperature in the water reaches a preset value. It also protects the main burner of the water heater in the event of malfunction where the water temperature could reach a cut-off point, which is usually 190° F. When the hot water in the tank reaches the preset value as set by the sensor 49 in the E.C.O. probe 46, the valve 45 shuts off the main gas supply line 20 (See FIG. 1).

As hereinshown the vapour sensors 22 and 25 are operated by a 12 volt battery or thermopile. When the battery or thermopile goes to a low charge, an alarm is sounded indicating that the battery needs to be replaced. These sensors, herein sensors 22 and 25, are connected through the high heat detector probe, 46, and to the relay coil 47. As soon as these sensors are open, the relay coil 47 to move the gas shut-off valve 48 to a close position whereby to cut-off the supply of gas to the pilot 17 and burner 16 to extinguish them.

Figure 7:
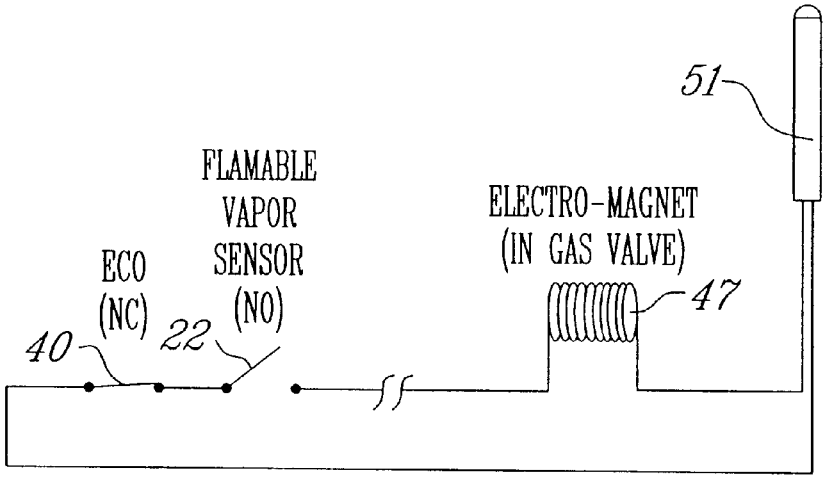
FIG. 7 is a schematic diagram showing the connection of the vapour sensor to the electro magnet of a gas valve.
Figure 8:
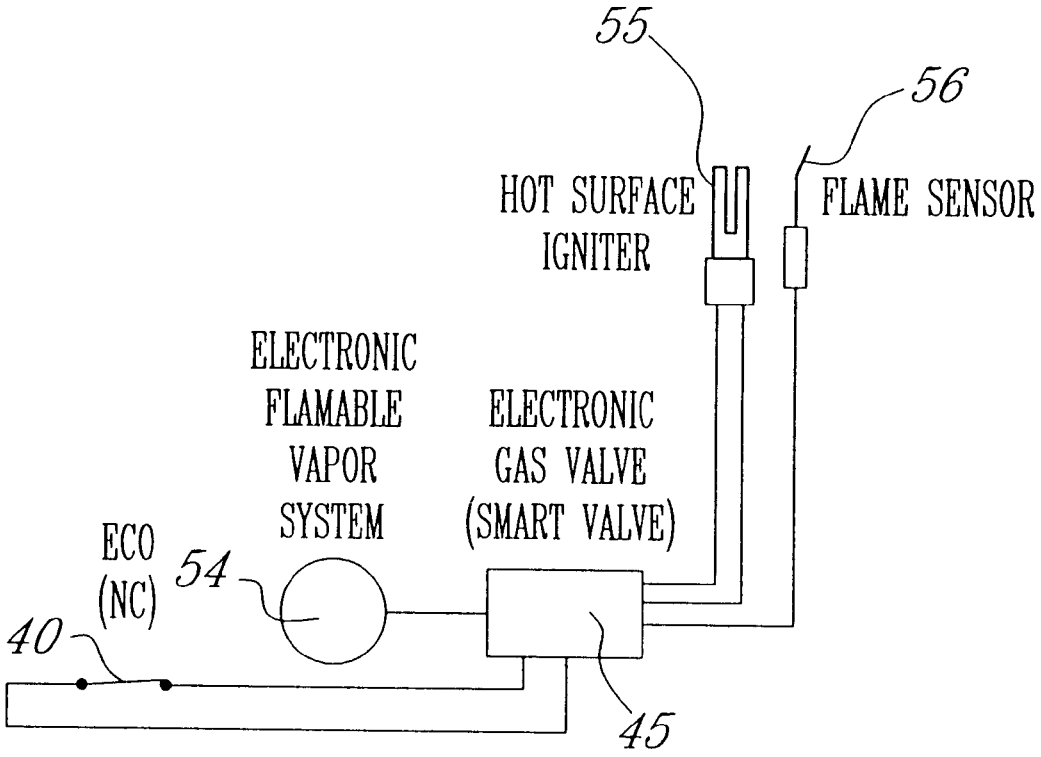
FIG. 8 is a schematic diagram showing the vapour detector system connected to the gas valve and the hot surface igniter of the burner.

Referring now to FIG. 7 there is illustrated the connection of a vapour sensor, such as vapour sensor 22 to the electro magnet or relay coils 47. The supply of the coil is by the E.G. as is obvious to a person skilled in the art. As hereinshown, a hot surface igniter 55 is used instead of a gas pilot and wherein the vapour sensor generally indicated by reference numeral 54 controls the gas valve 45 and hence the hot surface igniter 55 of the gas burner as the igniter is only provided a current when the electromagnetic valve is opened. A flame sensor 56 detects the presence of the flame. When the valve 45 is closed the igniter is off.

It is within the ambit of the present invention to cover any obvious modifications of the preferred embodiments described herein providing such modifications fall within the scope of the appended claims.

What is claimed is:

1. An elevating base for rendering a gas-fired water heater having a lower combustion chamber, explosion proof; said base having elevating support means to support said water heater elevated from a floor surface, one or more vapour detectors associated with said base to detect the presence of combustible vapours, said vapour detectors being connected to switching means to shut-off a gas burner and pilot in said combustion chamber before said combustible vapours reach said gas burner and pilot through combustion chamber air supply passages in a lower end of said gas water heater housing, said elevating support means having securement means for securing said base to a bottom end of a gas water heater housing, said one or more vapour detectors being secured in a lower part of said base to be positioned close to a floor surface for early detection of heavier than air combustible gases, and a second optional vapour detector secured in an upper portion of said base to provide an additional safety detection at a higher level of said base below said combustion chamber.

2. A base as claimed in claim 1 wherein said base elevating support means is constituted by a cylindrical contour wall.

3. A base as claimed in claim 2 wherein said contour wall is formed by metal sheeting or molded material, said securement means being constituted by a top support wall portion capable of being fastened to a contour bottom end of a gas water heater housing.

4. A base as claimed in claim 3 wherein said contour bottom end is secured by welding same to said top support wall portion.

5. A base as claimed in claim 4 wherein said top support wall portion is an inner flange portion of said cylindrical contour wall.

6. A base as claimed in claim 4 wherein said top support wall portion is a flat top wall of said base.

7. A base as claimed in claim 2 wherein said securement means is constituted by an adaptor ring securing said base to said bottom end of a gas water heater, said adaptor ring providing for the retrofit securement of said base to varying size water heater housings.

8. A base as claimed in claim 2 wherein said contour wall is provided with apertures thereabout for the circulation of air.

9. A base as claimed in claim 2 wherein said cylindrical contour wall is provided with projecting flanges to secure said base to a lower portion of a gas water heater housing by press-fit.

10. A base as claimed in claim 1 wherein said vapour detector is a battery operated N.O. switch which when activated upon detection of combustible vapours will shut off a gas supply valve to extinguish said pilot and gas burner.

11. A base as claimed in claim 1 wherein said base has a predetermined height whereby to position air intake passages for the combustion chamber a predetermined distance from said floor surface to provide for sufficient time to shut down a gas supply valve and to permit said combustion chamber to cool.

12. A base as claimed in claim 1 in combination with a gas water heater having a non-sealed combustion chamber.

13. An elevating base for rendering a gas-fired water heater having a lower combustion chamber, explosion proof; said base having elevating support means to support said water heater elevated from a floor surface, one or more vapour detectors associated with said base to detect the presence of combustible vapours, said vapour detectors being connected to switching means to shut-off a gas burner and pilot in said combustion chamber before said combustible vapours reach said gas burner and pilot through combustion chamber air supply passages in a lower end of said gas water heater housing, said elevating support means being a cylindrical contour wall having securement means for securing said base to a bottom end of a gas water heater housing, said contour wall being formed by metal sheeting or molded material, said securement means being constituted by a top support wall portion capable of being fastened to a contour bottom end of a gas water heater housing.

14. A base as claimed in claim 13 wherein one of said one or more vapour detectors is secured in a lower part of said base to be positioned close to a floor surface for early detection of heavier than air combustible gases.

15. A base as claimed in claim 14 wherein a second optional vapour detector is secured in an upper portion of said base to provide an additional safety detection at a higher level of said base below said combustion chamber.

16. A base as claimed in claim 14 wherein said vapour detector is a battery operated N.O. switch which when activated upon detection of combustible vapours will shut off a gas supply valve to extinguish said pilot and gas burner.

17. A base as claimed in claim 14 wherein said base has a predetermined height whereby to position air intake passages for the combustion chamber a predetermined distance from said floor surface to provide for sufficient time to shut down a gas supply valve and to permit said combustion chamber to cool.

18. A base as claimed in claim 13 in combination with a gas water heater having a non-sealed combustion chamber.

19. A base as claimed in claim 13 wherein said contour bottom end is secured by welding same to said top support wall portion.

20. A base as claimed in claim 19 wherein said top support wall portion is an inner flange portion of said cylindrical contour wall.

21. A base as claimed in claim 19 wherein said top support wall portion is a flat top wall of said base.

22. A base as claimed in claim 13 wherein said securement means is constituted by an adaptor ring securing said base to said bottom end of a gas water heater, said adaptor ring providing for the retrofit securement of said base to varying size water heater housings.

23. A base as claimed in claim 13 wherein said contour wall is provided with apertures thereabout for the circulation of air.

24. A base as claimed in claim 13 wherein said cylindrical contour wall is provided with projecting flanges to secure said base to a lower portion of a gas water heater housing by press-fit.

25. An elevating base for rendering a gas-fired water heater having a lower combustion chamber, explosion proof; said base having elevating support means to support said water heater elevated from a floor surface, one or more vapour detectors associated with said base to detect the presence of combustible vapours, said vapour detectors being connected to switching means to shut-off a gas burner and pilot in said combustion chamber before said combustible vapours reach said gas burner and pilot through combustion chamber air supply passages in a lower end of said gas water heater housing, said elevating support means being a cylindrical contour wall having securement means for securing said base to a bottom end of a gas water heater housing said securement means being an adaptor ring securing said base to said bottom end of a gas water heater, said adaptor ring providing for the retrofit securement of said base to varying size water heater housings.

26. A base as claimed in claim 25 wherein one of said one or more vapour detectors is secured in a lower part of said base to be positioned close to a floor surface for early detection of heavier than air combustible gases.

27. A base as claimed in claim 26 wherein a second optional vapour detector is secured in an upper portion of said base to provide an additional safety detection at a higher level of said base below said combustion chamber.

28. A base as claimed in claim 26 wherein said vapour detector is a battery operated N.O. switch which when activated upon detection of combustible vapours will shut off a gas supply valve to extinguish said pilot and gas burner.

29. A base as claimed in claim 26 wherein said base has a predetermined height whereby to position air intake passages for the combustion chamber a predetermined distance from said floor surface to provide for sufficient time to shut down a gas supply valve and to permit said combustion chamber to cool.

30. A base as claimed in claim 25 wherein said base elevating support means is constituted by a cylindrical contour wall.

31. A base as claimed in claim 30 wherein said contour wall is formed by metal sheeting or molded material, said securement means being constituted by a top support wall portion capable of being fastened to a contour bottom end of a gas water heater housing.

32. A base as claimed in claim 31 wherein said contour bottom end is secured by welding same to said top support wall portion.

33. A base as claimed in claim 32 wherein said top support wall portion is an inner flange portion of said cylindrical contour wall.

34. A base as claimed in claim 32 wherein said top support wall portion is a flat top wall of said base.

35. A base as claimed in claim 30 wherein said contour wall is provided with apertures thereabout for the circulation of air.

36. A base as claimed in claim 30 wherein said cylindrical contour wall is provided with projecting flanges to secure said base to a lower portion of a gas water heater housing by press-fit.

37. A base as claimed in claim 25 in combination with a gas water heater having a non-sealed combustion chamber.

38. An elevating base for rendering a gas-fired water heater having a lower combustion chamber, explosion proof; said base having elevating support means to support said water heater elevated from a floor surface, one or more vapour detectors associated with said base to detect the presence of combustible vapours, said vapour detectors being connected to switching means to shut-off a gas burner and pilot in said combustion chamber before said combustible vapours reach said gas burner and pilot through combustion chamber air supply passages in a lower end of said gas water heater housing, said elevating support means being a cylindrical contour wall having securement means for securing said base to a bottom end of a gas water heater housing, said cylindrical contour wall having projecting flanges to secure said base to a lower portion of a gas water heater housing by press-fit.

39. A base as claimed in claim 38 wherein one of said one or more vapour detectors is secured in a lower part of said base to be positioned close to a floor surface for early detection of heavier than air combustible gases.

40. A base as claimed in claim 39 wherein a second optional vapour detector is secured in an upper portion of said base to provide an additional safety detection at a higher level of said base below said combustion chamber.

41. A base as claimed in claim 39 wherein said vapour detector is a battery operated N.O. switch which when activated upon detection of combustible vapours will shut off a gas supply valve to extinguish said pilot and gas burner.

42. A base as claimed in claim 39 wherein said base has a predetermined height whereby to position air intake passages for the combustion chamber a predetermined distance from said floor surface to provide for sufficient time to shut down a gas supply valve and to permit said combustion chamber to cool.

43. A base as claimed in claim 38 wherein said contour wall is formed by metal sheeting or molded material, said securement means being constituted by a top support wall portion capable of being fastened to a contour bottom end of a gas water heater housing.

44. A base as claimed in claim 43 wherein said contour bottom end is secured by welding same to said top support wall portion.

45. A base as claimed in claim 44 wherein said top support wall portion is an inner flange portion of said cylindrical contour wall.

46. A base as claimed in claim 44 wherein said top support wall portion is a flat top wall of said base.

47. A base as claimed in claim 38 wherein said securement means is constituted by an adaptor ring securing said base to said bottom end of a gas water heater, said adaptor ring providing for the retrofit securement of said base to varying size water heater housings.

48. A base as claimed in claim 38 wherein said contour wall is provided with apertures thereabout for the circulation of air.

49. A base as claimed in claim 38 in combination with a gas water heater having a non-sealed combustion chamber.

50. An elevating base for rendering a gas-fired water heater having a lower combustion chamber, explosion proof; said base having elevating support means to support said water heater elevated from a floor surface, one or more vapour detectors associated with said base to detect the presence of combustible vapours, said vapour detectors being connected to switching means to shut-off a gas burner and pilot in said combustion chamber before said combustible vapours reach said gas burner and pilot through combustion chamber air supply passages in a lower end of said gas water heater housing, said elevating support means having securement means for securing said base to a bottom end of a gas water heater housing, one of said one or more vapour detectors being secured in a lower part of said base to be positioned close to a floor surface for early detection of heavier than air combustible gases, said base having a predetermined height whereby to position air intake passages for the combustion chamber a predetermined distance from said floor surface to provide for sufficient time to shut down a gas supply valve and to permit said combustion chamber to cool.

51. A base as claimed in claim 50 wherein a second optional vapour detector is secured in an upper portion of said base to provide an additional safety detection at a higher level of said base below said combustion chamber.

52. A base as claimed in claim 50 wherein said base elevating support means is constituted by a cylindrical contour wall.

53. A base as claimed in claim 52 wherein said contour wall is formed by metal sheeting or molded material, said securement means being constituted by a top support wall portion capable of being fastened to a contour bottom end of a gas water heater housing.

54. A base as claimed in claim 53 wherein said contour bottom end is secured by welding same to said top support wall portion.

55. A base as claimed in claim 54 wherein said top support wall portion is an inner flange portion of said cylindrical contour wall.

56. A base as claimed in claim 54 wherein said top support wall portion is a flat top wall of said base.

57. A base as claimed in claim 52 wherein said securement means is constituted by an adaptor ring securing said base to said bottom end of a gas water heater, said adaptor ring providing for the retrofit securement of said base to varying size water heater housings.

58. A base as claimed in claim 52 wherein said contour wall is provided with apertures thereabout for the circulation of air.

59. A base as claimed in claim 52 wherein said cylindrical contour wall is provided with projecting flanges to secure said base to a lower portion of a gas water heater housing by press-fit.

60. A base as claimed in claim 50 wherein said vapour detector is a battery operated N.O. switch which when activated upon detection of combustible vapours will shut off a gas supply valve to extinguish said pilot and gas burner.

61. A base as claimed in claim 50 in combination with a gas water heater having a non-sealed combustion chamber.

62. An elevating base in combination with a gas-fired water heater having a lower non-sealed combustion chamber for rendering said gas-fired water heater explosion proof; said base having elevating support means to support said water heater elevated from a floor surface, one or more vapour detectors associated with said base to detect the presence of combustible vapours, said vapour detectors being connected to switching means to shut-off a gas burner and pilot in said combustion chamber before said combustible vapours reach said gas burner and pilot through combustion chamber air supply passages in a lower end of said gas water heater housing.

63. A base as claimed in claim 62 wherein said elevating support means is provided with securement means for securing said base to a bottom end of a gas water heater housing.

64. A base as claimed in claim 63 wherein one of said one or more vapour detectors is secured in a lower part of said base to be positioned close to a floor surface for early detection of heavier than air combustible gases.

65. A base as claimed in claim 64 wherein a second optional vapour detector is secured in an upper portion of said base to provide an additional safety detection at a higher level of said base below said combustion chamber.

66. A base as claimed in claim 64 wherein said vapour detector is a battery operated N.O. switch which when activated upon detection of combustible vapours will shut off a gas supply valve to extinguish said pilot and gas burner.

67. A base as claimed in claim 64 wherein said base has a predetermined height whereby to position air intake passages for the combustion chamber a predetermined distance from said floor surface to provide for sufficient time to shut down a gas supply valve and to permit said combustion chamber to cool.

68. A base as claimed in claim 63 wherein said base elevating support means is constituted by a cylindrical contour wall.

69. A base as claimed in claim 68 wherein said contour wall is formed by metal sheeting or molded material, said securement means being constituted by a top support wall portion capable of being fastened to a contour bottom end of a gas water heater housing.

70. A base as claimed in claim 69 wherein said contour bottom end is secured by welding same to said top support wall portion.

71. A base as claimed in claim 70 wherein said top support wall portion is an inner flange portion of said cylindrical contour wall.

72. A base as claimed in claim 70 wherein said top support wall portion is a flat top wall of said base.

73. A base as claimed in claim 68 wherein said securement means is constituted by an adaptor ring securing said base to said bottom end of a gas water heater, said adaptor ring providing for the retrofit securement of said base to varying size water heater housings.

74. A base as claimed in claim 68 wherein said contour wall is provided with apertures thereabout for the circulation of air.

75. A base as claimed in claim 68 wherein said cylindrical contour wall is provided with projecting flanges to secure said base to a lower portion of a gas water heater housing by press-fit.

* * * * *